US011697483B2

(12) United States Patent
Despineux et al.

(10) Patent No.: US 11,697,483 B2
(45) **Date of Patent: *Jul. 11, 2023**

(54) DRIVE ARRANGEMENT WITH AN ARRESTING ELEMENT FOR PROPELLING A BOAT

(71) Applicant: Torqeedo GmbH, Wessling (DE)

(72) Inventors: Frank Despineux, Wessling (DE); Dominik Busse, Munich (DE)

(73) Assignee: Torqeedo GmbH, Wessling (DE)

( * ) Notice: Subject to any disclaimer, the term of this patent is extended or adjusted under 35 U.S.C. 154(b) by 107 days.

This patent is subject to a terminal disclaimer.

(21) Appl. No.: 17/318,034

(22) Filed: May 12, 2021

(65) Prior Publication Data

US 2021/0371069 A1 Dec. 2, 2021

Related U.S. Application Data

(63) Continuation of application No. 16/666,200, filed on Oct. 28, 2019, now Pat. No. 11,066,141.

(30) Foreign Application Priority Data

Oct. 30, 2018 (DE) ..... 102018127096.8

(51) Int. Cl.
*B63H 20/10* (2006.01)
*B63H 21/17* (2006.01)
*B63B 34/20* (2020.01)

(52) U.S. Cl.
CPC ..... *B63H 20/106* (2013.01); *B63B 34/20* (2020.02); *B63H 21/17* (2013.01)

(58) Field of Classification Search
CPC ..... B63H 20/106; B63H 21/17; B63B 34/20
See application file for complete search history.

(56) References Cited

U.S. PATENT DOCUMENTS 2,908,242 A * 10/1959 Forbes ..... B63H 20/06 440/61 R
3,075,490 A * 1/1963 Lang ..... B63H 21/305 248/642
3,906,887 A * 9/1975 Kappas ..... B63H 20/007 310/87
4,395,238 A * 7/1983 Payne ..... B63H 20/10 248/642

(Continued)

FOREIGN PATENT DOCUMENTS

CN 106672188 A 3/2019

OTHER PUBLICATIONS

"Torqeedo Katalog 2009," 2009, 24 pages.
"Operating Manual Ultralight 402," Sep. 15, 2009, 64 pages.
"Torqeedo Katalog 2010," 2010, 24 pages.
"Torqeedo Katalog 2011," 2011, 24 pages.
"Torqeedo Katalog 2012," 2012, 32 pages.

(Continued)

*Primary Examiner* — S. Joseph Morano
*Assistant Examiner* — Jovon E Hayes
(74) *Attorney, Agent, or Firm* — Greenberg Traurig, LLP; David J. Dykeman; Roman Fayerberg

(57) ABSTRACT

System and methods are provided that relate to a drive arrangement for propelling a boat, in particular a kayak. In some embodiments, the drive arrangement can include an electric drive motor with a shaft and a receiving device for receiving the shaft. An arresting element can be provided for determining a first desired distance along the shaft between the receiving device and the drive motor.

17 Claims, 6 Drawing Sheets

(56) References Cited

U.S. PATENT DOCUMENTS

| | | | | |
|---|---|---|---|---|
| 4,669,987 | A * | 6/1987 | Schulte | B63H 20/007 440/58 |
| 4,713,028 | A * | 12/1987 | Duff | B63H 20/106 248/641 |
| 4,715,836 | A * | 12/1987 | Schulte | B63H 20/12 440/58 |
| 7,228,810 | B2 * | 6/2007 | Brown | B63B 1/125 248/642 |
| 7,390,231 | B1 * | 6/2008 | Pelini | B63H 21/16 440/61 E |
| 2004/0229523 | A1 * | 11/2004 | Campbell | B63H 20/08 440/56 |
| 2008/0299842 | A1 * | 12/2008 | Ellis | G05D 1/0206 440/6 |
| 2011/0014829 | A1 * | 1/2011 | Burke | B63H 21/17 440/63 |
| 2020/0130800 | A1 * | 4/2020 | Despineux | B63H 20/106 |

OTHER PUBLICATIONS

"Torqeedo Katalog 2013," 2013, 21 pages.
"Torqeedo Katalog 2014," 2014, 46 pages.
"Torqeedo 2015," 2015, 64 pages.
"Torqeedo Electric Boating 2016," 2016, 74 pages.
"Operating Manual Ultralight 403," Mar. 22, 2016, 72 pages.
Güldenring, Sabine, "Service Manual Ultralight 403 and 1103," Mar. 23, 2016, 17 pages.
"Torqeedo Electric Boating 2017," 2017, 76 pages.
"Torqeedo Electric Boating 2018," 2018, 76 pages.

* cited by examiner

DRIVE ARRANGEMENT WITH AN ARRESTING ELEMENT FOR PROPELLING A BOAT

RELATED APPLICATIONS

This application is a continuation patent application of U.S. application Ser. No. 16/666,200, filed Oct. 28, 2019, which claims priority to and the benefit of German Patent Application No. DE 10 2018 127096.8, filed Oct. 30, 2018, the entirety of each of which is incorporated herein by reference.

FIELD

The present disclosure relates to a drive arrangement for propelling a boat as well as a boat with such a drive arrangement.

BACKGROUND

The navigation of boats in shallow water often presents a skipper with challenges. Sports fishermen in particular must often cross a broad area of relatively shallow water to reach high-yield fishing areas, which are often also located in shallow waters. The depth of the water in these shallow water areas will not always allow the safe operation of an outboard engine. Contact with the ground will not only result in warping, spalling, deformation or breaking the propeller of the engine, but can also damage the shaft of the outboard engine. This can bring with it not only inconvenience connected with paddling back to the starting point, but also extremely costly repairs.

U.S. Pat. No. 4,713,028 A describes a boat that allows operation in shallow water, using an outboard engine with a propeller. The boat here comprises a main skin and an adjustable transom, by device of which the engine can be lowered for normal operation and lifted for shallow water operation. Lifting the adjustable transom serves for lifting the engine and preventing damage to the propeller as well as for lifting an adjustable hull section at the same time in order to provide a flow channel for guiding water to the propeller and to the suction opening of the engine for correct and efficient cooling. Such a device does however necessitate knowing the depth of the water, i.e. the skipper must lift the engine himself by way of prevention before he navigates shallow water. Against the background that a skipper does not always know the depth of the water in areas in which he navigates or anticipates that he may be distracted whilst fishing, he will lift the engine early to prevent a collision of the engine with the ground. This device that the boat cannot always be optimally operated. The device is further adapted to a special boat configuration, which requires a device for adjusting a moveable hull section. This device can therefore not be used on boats without such an adjustable hull section.

SUMMARY

A drive arrangement is provided that offers improved safety when travelling in shallow water areas and that can be adapted in a simple way to different boat configurations.

A drive arrangement is accordingly suggested for propelling a boat, in particular a kayak, having an electric drive motor with a shaft and a receiving device for receiving the shaft. In some embodiments, an arresting element is provided for determining a first desired distance along the shaft between the receiving device and the drive motor.

It has been found that the submersion depth of the drive motor and the arrangement of the steering device can be quickly adapted through providing an arresting element. The drive arrangement can be efficiently and easily adapted to different boat configurations and boat geometries in the stern area in this way.

The first desired distance is the distance between the receiving device and the drive motor, and the distance between an underside of the receiving device and an axis of rotation of the drive motor is for example measured.

In some embodiments, the arresting element can also be used for determining a second desired distance between a steering device and a drive motor, or between the steering device and the receiving device and thus the surface of the boat.

The second desired distance can then be the distance between the steering device and the drive motor, and the distance is also, for example, measured between an underside of the steering device and an axis of rotation of the drive motor.

In some embodiments, the arresting element encompasses the shaft in such a way that the arresting element can be displaced along the longitudinal axis of the shaft. In this way the arresting element can be variably displaced along the longitudinal axis and can for example arrest the steering device in a desired position along the longitudinal axis of the shaft.

In some embodiments, the arresting element can be shifted into an opened position and into a closed position. The arresting element can be displaced along the longitudinal axis of the shaft in the opened position. In some embodiments, the arresting element is fixed in the closed position along the longitudinal axis of the shaft.

In some embodiments, the arresting element is designed as a clamp with a quick-release lever, wherein the arresting element can be shifted into the closed position through tensioning the quick-release lever, and into the opened position through loosening the quick-release lever.

In some embodiments, the clamp can have a receptacle, which serves for receiving the cross-section of the shaft. The receptacle of the clamp can correspondingly be of a round or annular design for a shaft with a round cross-section. With other geometries of the cross-section of the shaft the receptacle is designed correspondingly different.

The quick-release lever can have a familiar design, for example an axle with a nut, which can be tensioned in axial direction with the aid of an excenter lever.

The clamp can also cooperate with the shaft in such a way that it is torque-proof with regard to the axis of the shaft—for example by forming a groove in the shaft and a corresponding engagement element on the clamp.

A torque-proof connection also results—in addition to an adequate clamping or an engagement with a groove—from a corresponding geometry of the shaft, which can also be of an oval or angular design, wherein the clamp can then have a corresponding receptacle.

In some embodiments, the shaft is connected with the receiving device in such a way that the shaft can be rotated around a longitudinal axis of the shaft and the shaft is displaceable relative to the receiving device along the longitudinal axis of the shaft.

In some embodiments, the shaft is connected with a steering device in such a way that the steering device is displaceable along the longitudinal axis of the shaft. A steering request entered by means of the steering device fitted to the shaft can be correspondingly converted into a rotation of the shaft around its longitudinal axis by means of separate steering elements—for example steering lines—for steering the boat accordingly.

In some embodiments, an arresting element is integrated into the steering means, i.e. integrally provided in the steering means. This allows the steering device to be positioned and fixed in the desired position along the longitudinal axis of the shaft with a few hand movements.

In some embodiments, the steering device is arranged either above or below the receiving device and can lie against the receiving device in order to prevent a displacement of the shaft in relation to the receiving device in this direction.

In some embodiments, the arresting element can be arranged in such a way in the closed position that either the receiving device or the steering device lies on the arresting element to block a displacement of the shaft in the direction of an upper end along the longitudinal axis of the shaft, and thus to set the first desired distance and the second desired distance.

In some embodiments, a further arresting element can be provided, wherein the further arresting element is arranged between the receiving device and the steering device in such a way that the receiving device and the steering device are spaced apart from each other. In this way the steering device can be adjusted along the longitudinal axis of the shaft into a desired height position independently from the receiving device, or vice versa.

In some embodiments, the further arresting element is integrated in the steering means. In some embodiments, the further arresting element is a further independent annular clamp with a quick-release lever, wherein the arresting element can be shifted into the closed position through tensioning the quick-release lever and into the opened position by loosening the quick-release lever.

In some embodiments the further arresting element can be arranged in the closed position in such a way that either the steering device or the receiving device lies on the further arresting element to block the steering device or the receiving device against a displacement in the direction of an upper end along the longitudinal axis of the shaft, and therefore to set the first and second desired distance independently from each other. Whether the receiving device or the steering device lie on the further arresting element will depend on whether the steering device is arranged above or below the receiving device.

In some embodiments, the steering device can be secured on the shaft against axial slipping by device of its own clamping. The steering device does not need to lie on the arresting element here.

In some embodiments, a connection device can be arranged on an upper end of the shaft.

The upper end of the shaft here means the end of the shaft that is arranged above the water level during operation, and which is therefore the end of the shaft that lies opposite the drive motor.

In some embodiments the connection device has a connector for connecting the drive motor to a power source, in particular a battery. In some embodiments, the connection device can also have an arresting function in addition to the function of supplying the drive motor with power, namely of blocking the shaft from falling out in a gravitational direction.

In some embodiments, a slipping out of the shaft can be prevented either with the arresting element or the steering device.

In some embodiments, a boat, in particular a kayak, with a drive arrangement is provided. The boat has a fitting area on a top of one boat end, where the drive arrangement can be fitted to the boat. In some embodiments, the fitting area is simultaneously a device for fitting an anchor, for example a motor-driven or manually drivable shallow water anchor in the form of an anchor post.

In some embodiments, the boat has at least two steering elements, wherein a steering element each is fitted to a leg of a steering device of the drive arrangement, so that the shaft can be rotated around its longitudinal axis into a first or second direction through activating one of the two steering elements to steer the boat. In some embodiments, the steering elements can be provided in the form of steering lines, which can for example be connected with steering pedals of the boat.

In some embodiments, the arresting element is provided for setting a second desired distance between the steering device and the drive motor along the longitudinal axis of the shaft in such a way that the steering elements and the steering device are aligned with each other in such a way that the steering elements extend substantially parallel to the top of the boat.

The at least two steering elements here extend below or above the top of the boat along a longitudinal axis of the boat. Depending on whether the steering elements extend above or below the top of the boat the position of the steering device is therefore adaptable to the respective situation along the longitudinal axis of the shaft.

In some embodiments, a further arresting element is provided for setting a first desired distance between the receiving device and the drive motor in such a way that the drive motor and the height of the stern are aligned with each other in such a way that the drive motor is submersed in the water in a desired position. The height of the stern differs depending on the type and model of the boat. The drive arrangement can be adapted to different stern heights with an arresting element. The drive arrangement can therefore be adapted to different boot types and boat models with different stern geometries.

In some embodiments, a drive arrangement is provided that includes an arresting element, with which the steering device and the submersion depth of the drive motor can be adapted to different boot configurations with a few hand movements. The shaft is displaceable relative to a receiving device along its longitudinal axis. The steering device is further displaceable along the shaft. The steering device and the receiving device can be arrested against a displacement along the longitudinal axis with little effort by means of the arresting element, which can be designed as a quick-release lever.

Further advantages and characteristics of the present disclosure are clear from the following description of embodiment examples. The characteristics described therein can be implemented independently or in combination with one or more of the characteristics illustrated above as long as the characteristics do not contradict each other. The following description of embodiment examples relates to the accompanying drawings.

BRIEF DESCRIPTION OF THE DRAWINGS

The present disclosure is further described in the detailed description which follows, in reference to the noted plurality of drawings by way of non-limiting examples of exemplary embodiments, in which like reference numerals represent similar parts throughout the several views of the drawings, and wherein.

DETAILED DESCRIPTION

The following description provides exemplary embodiments only, and is not intended to limit the scope, applicability, or configuration of the disclosure. Rather, the following description of the exemplary embodiments will provide those skilled in the art with an enabling description for implementing one or more exemplary embodiments. It will be understood that various changes may be made in the function and arrangement of elements without departing from the spirit and scope of the presently disclosed embodiments. Embodiment examples are described as follows with reference to the figures. Identical, similar or identically acting elements in the various figures are identified with identical reference numbers and a repeated description of these elements is omitted in part to avoid redundancies.

Figure 1:
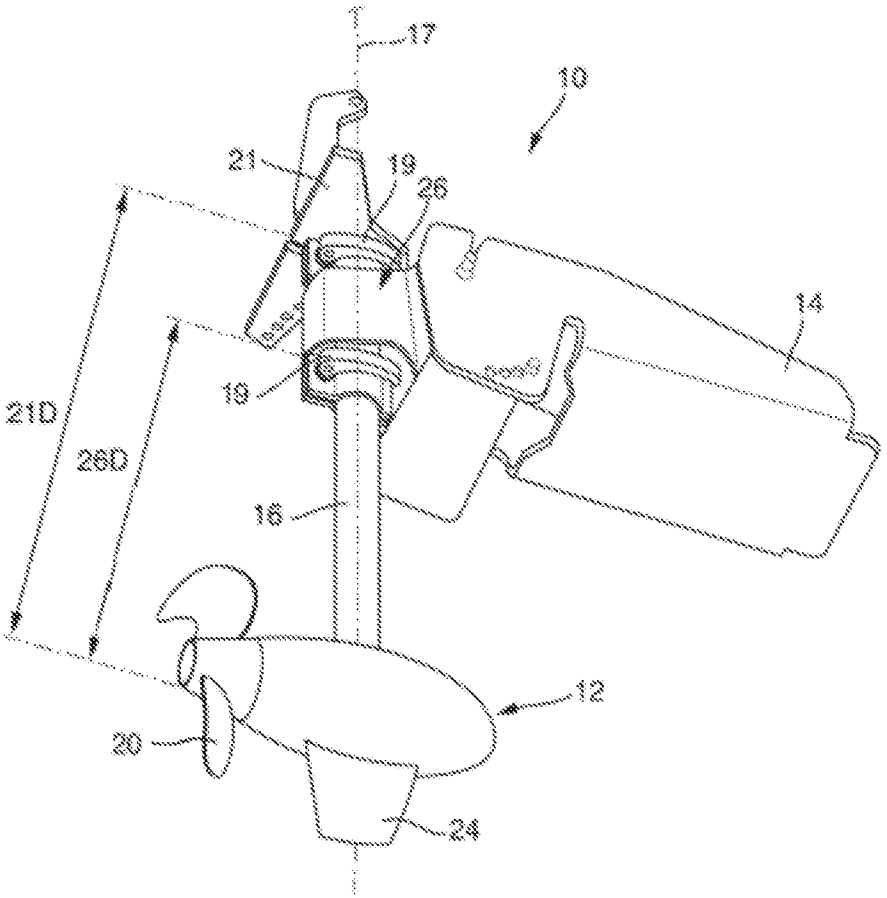
FIG. 1 is a perspective view of a drive arrangement according to some embodiments.

A schematic view of a drive arrangement 10 for propelling a boat, in particular a kayak, is shown in FIG. 1. The drive arrangement 10 has an electric drive motor 12 with a shaft 16, a receiving device 26 for receiving the shaft 16 and a holder 14 for holding the receiving device 26 on the boat. A steering device 21 for pivoting the drive motor 12 for steering the boat is also shown.

At least one arresting element 19 is provided for defining a first desired distance 26D between the receiving device 26 and the drive motor 12.

A second arresting element 19 is provided for defining a second desired distance 21D between the steering device 21 and the drive motor 12.

It has been found that use of the arresting element 19 allows a fast adaptation of the submersion depth of the drive motor 12 to respective situations and the arrangement of the steering device 21. The drive arrangement can be adapted to different boot dimensions, in particular geometries in the stern area, in this way. A pre-setting of the submersion depth of the electric motor 12, and therefore the shallow water features of the drive arrangement 10, can further be realized in a simple way.

In some embodiments, the arresting element 19 encompasses the shaft 16 in such a way that the arresting element 19 can be displaced along the longitudinal axis of the shaft 16 in an opened position. The arresting element 19 can be variably displaced along the longitudinal axis 17 of the shaft 16 in this way and the steering device 21 can for example be arrested in a desired position along the longitudinal axis of the shaft 16.

The arresting element 19 can be shifted into an opened position and into a closed position. The arresting element 19 can be displaced along the longitudinal axis of the shaft 16 in the opened position, whilst it is fixed along the longitudinal axis of the shaft 16 in the closed position, as shown here.

In some embodiments, the arresting element 19 is designed as a clamp with a quick-release lever, wherein the arresting element 19 can be shifted into the closed position through tensioning the quick-release lever, and into the opened position through loosening the quick-release lever.

The shape of a receiving area for receiving the shaft 16 in the arresting element 19 is normally adapted to the geometry of the cross-section of the shaft 16. With a round cross-section the receptacle for the shaft 16 is correspondingly round or annular.

In some embodiments, the shaft 16 is connected with the receiving device 26 in such a way that the shaft 16 can be rotated around a longitudinal axis 17 of the shaft 16, and the shaft 16 can be displaced relative to the receiving device 26 along the longitudinal axis 17 of the shaft 16.

The drive motor 12 has a propeller 20 and a rudder area 24.

Figure 2:
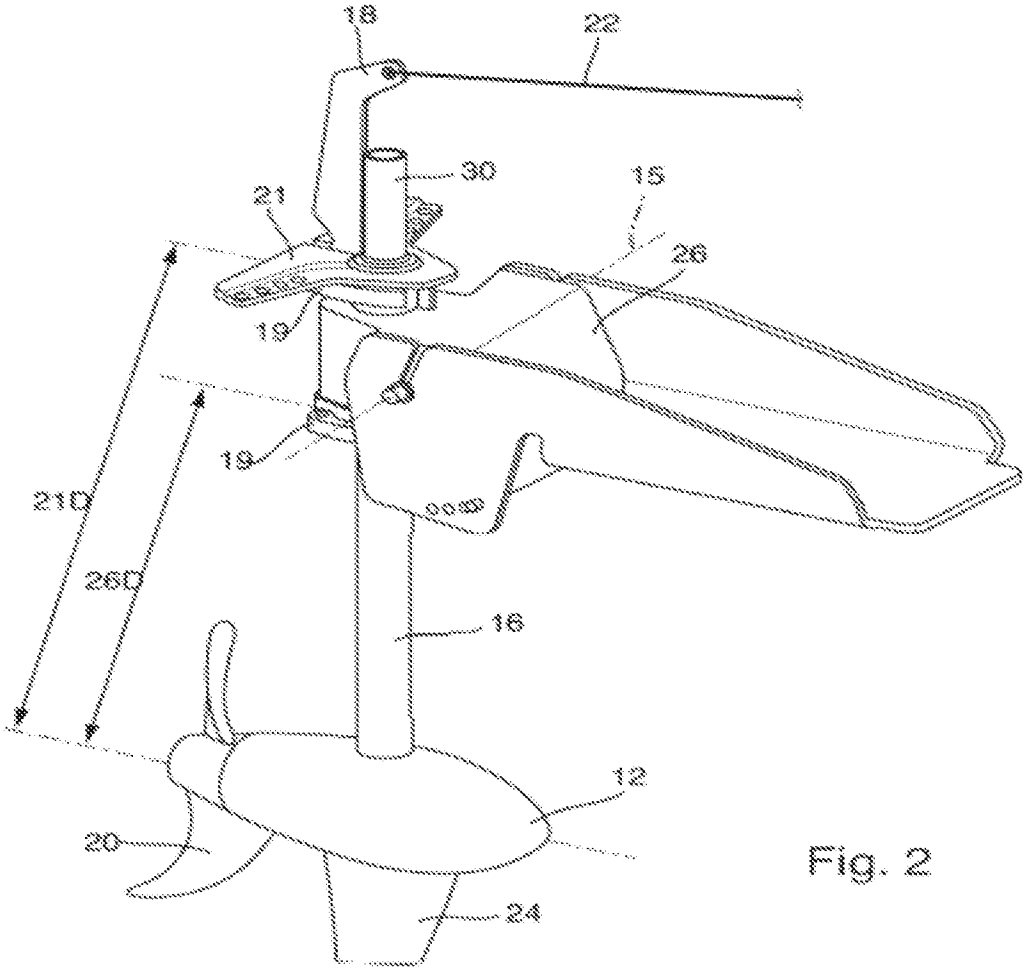
FIG. 2 is a perspective side view of the drive motor arrangement according to the embodiment of FIG. 1.
Figure 3:
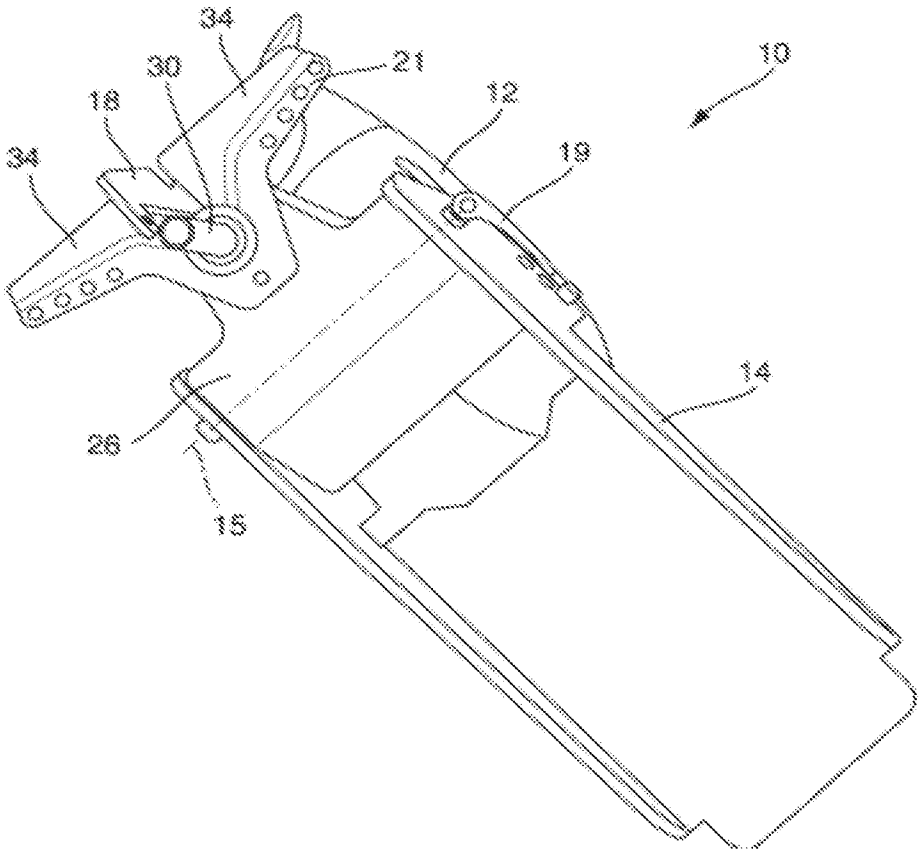
FIG. 3 is a perspective top view of the drive arrangement according to the embodiment of FIGS. 1 and 2.

In some embodiments as shown in FIGS. 1-3, the shaft 16 is connected with the steering device 21 in such a way that the steering device 21 can be displaced along the longitudinal axis 17 of the shaft 16. During operation the steering device 21 is however connected with the shaft 16 at least in a torque-proof way in order to be able to correspondingly transmit steering commands to the shaft 16.

Figure 5:
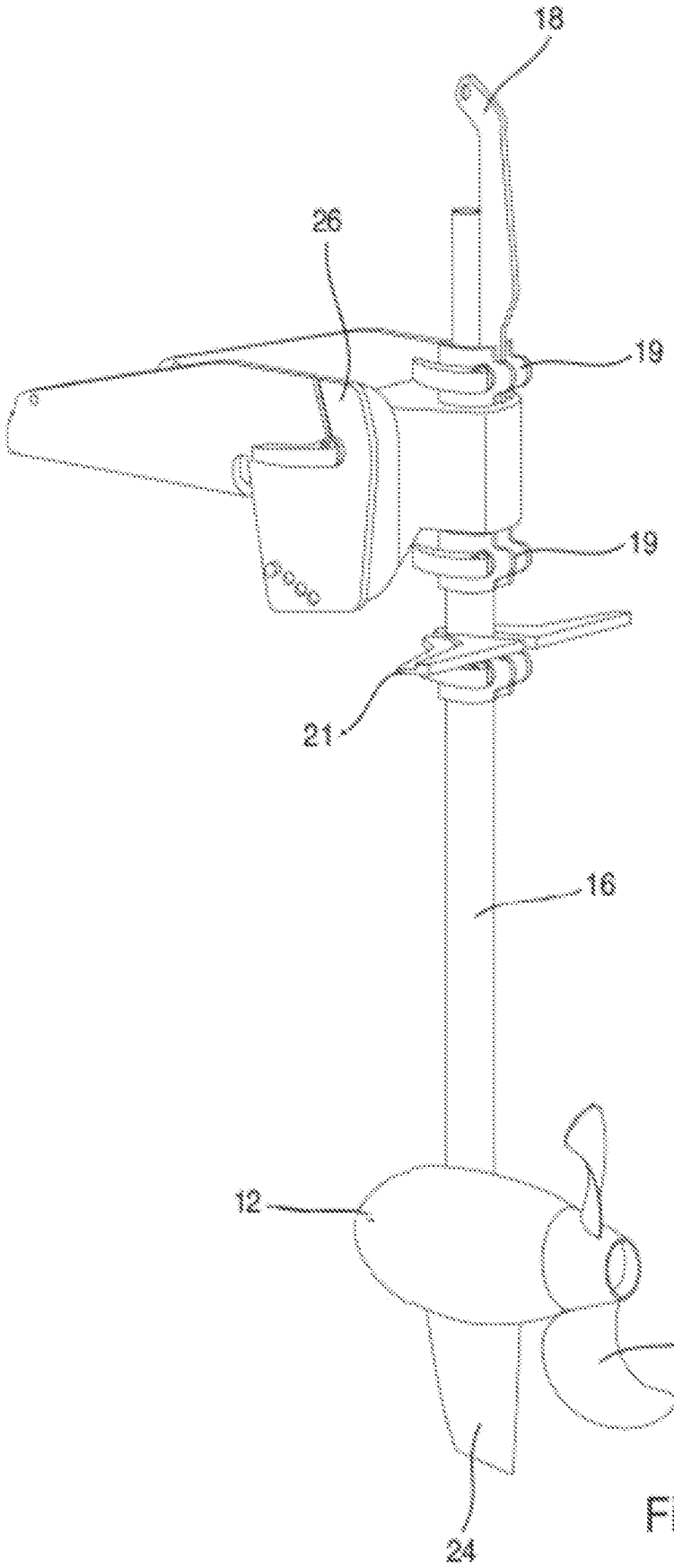
FIG. 5 is a perspective view of a drive arrangement according to some embodiments.

In an example shown in FIG. 5, an arresting element 19 is integrated into the steering device 21, i.e. is integrally provided in the steering means. The steering device 21 can be positioned and fixed in the desired position with a few hand movements independently from the arresting elements 19 and the receiving device 26 along the longitudinal axis of the shaft in this way.

In some embodiments, the steering device 21 is arranged below the receiving device 26 at a pre-determined distance to the arresting element 19 in FIG. 5. In some embodiments, not illustrated, the steering device 21 can also be arranged above the receiving device at a pre-determined distance to the arresting element 19.

In some embodiments, the steering device 21 is arranged either above or below the receiving device 26 (see FIGS. 4A-4B) and lies against the receiving device 26.

The arresting element 19 can be arranged in the closed position in such a way that either the receiving device 26 or the steering device 21 can lie on the arresting element 19 to block the shaft 16 against a displacement in the direction of an upper end along the longitudinal axis of the shaft, and thus for setting the first desired distance and the second desired distance.

Figure 4A:
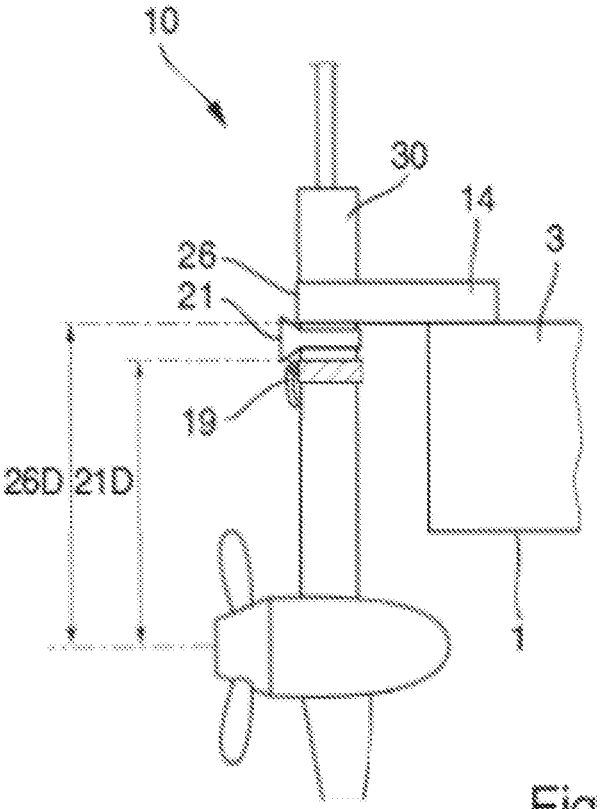
FIGS. 4A, 4B, 4C, and 4D illustrate a schematic view of the various setting possibilities of the drive motor arrangement according to some embodiments.

In the example shown in FIG. 4A the steering device 21 lies on an arresting element 19. The receiving device 26 is fitted to a stern area of the boat 1 by means of the holder 14. The steering device 21 is therefore fixed between the receiving device 26 and the arresting element 19.

In some embodiments, the steering device can be secured against axial slipping on the shaft through its own clamping. The steering device therefore does not have to lie on the arresting element. In the clamped condition the steering device can therefore not be axially displaced. Steering transmission can take place only in the clamped condition. In a non-clamped condition, the steering device can be displaced along the shaft, wherein no steering transmission can take place in this condition.

The steering device 21, as well as the shaft 16 itself, can be displaced along the longitudinal axis of the shaft 16 through loosening the arresting element 19. The shaft can be held prior to falling out in a gravitational direction by device of a connection device 30. In some embodiments, the slipping out of the shaft 16 is prevented either by the arresting element 19 or by the steering device 21.

Figure 4B:
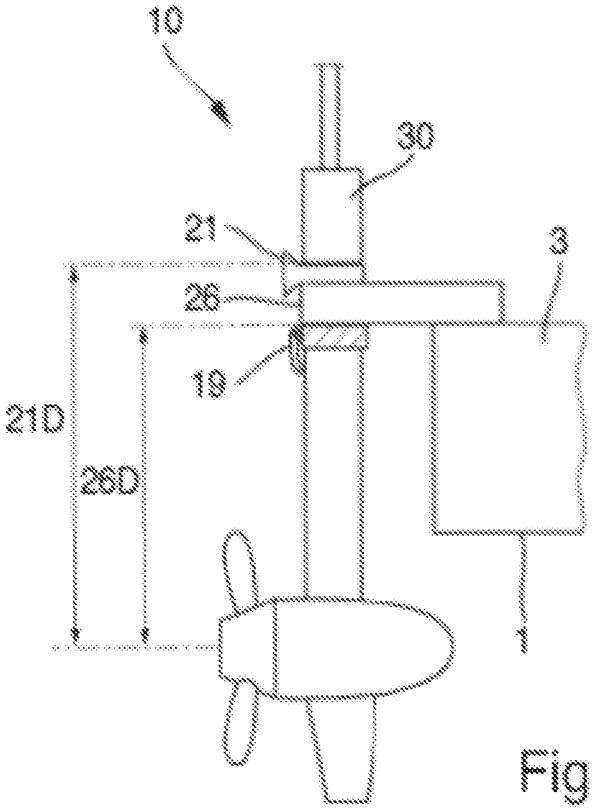

In FIG. 4B, the steering device 21 is positioned above the receiving device 26. This is for example the case when the steering elements extend above the top of the boat. In this shown example the shaft 16 is fixed against a displacement along the longitudinal direction of the shaft 16 by the arresting element 19. In some embodiments, the slipping out of the shaft 16 is prevented either by the arresting element 19 or the steering device 21. As shown the steering device lies on the receiving device 26. Distances 21D and 26D are set in this way.

As shown in FIGS. 1-3 and FIGS. 4C-D, a further arresting element 19 can be provided, wherein the further arresting element 19 is arranged between the receiving device 26 and the steering device 21 in such a way that the receiving device 26 and the steering device 21 are at a distance from each other. The steering device 21 can be adjusted into a desired height position along the longitudinal axis 17 of the shaft 16 independently from the receiving device 26, or also vice versa, in this way. In some embodiments, not shown, the further arresting element 19 is integrated in the steering device 21. In the example shown here the further arresting element 19 is a further independent annular clamp with a quick-release lever, wherein the arresting element 19 can be shifted into the closed position through tensioning the quick-release lever, or into the opened position through loosening the quick-release lever.

In some embodiments, the further arresting element 19 is arranged in such a way in the closed position that either the steering device 21 or the receiving device 26 lie on the further arresting element 19 to block the steering device 21 or the receiving device 26 against a displacement in the direction of an upper end along the longitudinal axis 17 of the shaft 16, and thus to set the first desired distance 26D and the second desired distance 21D independently from each other.

Figure 4C:
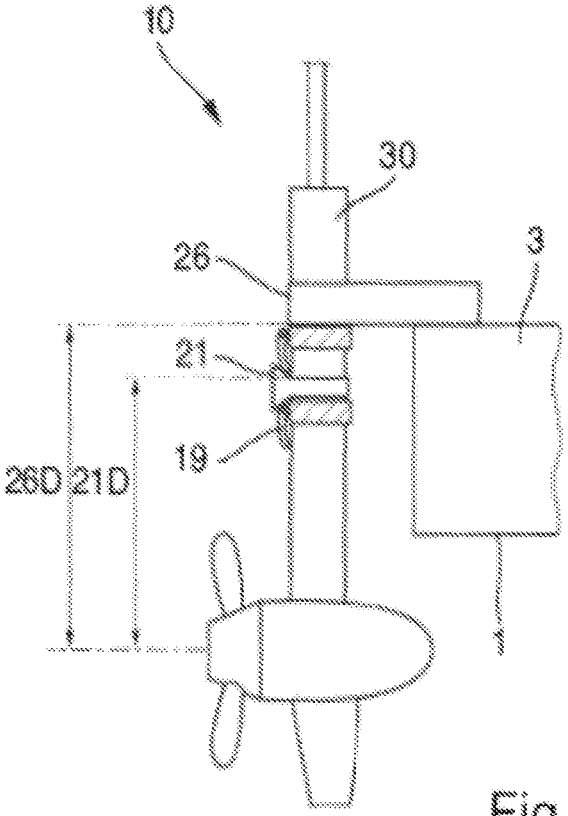
Figure 4D:
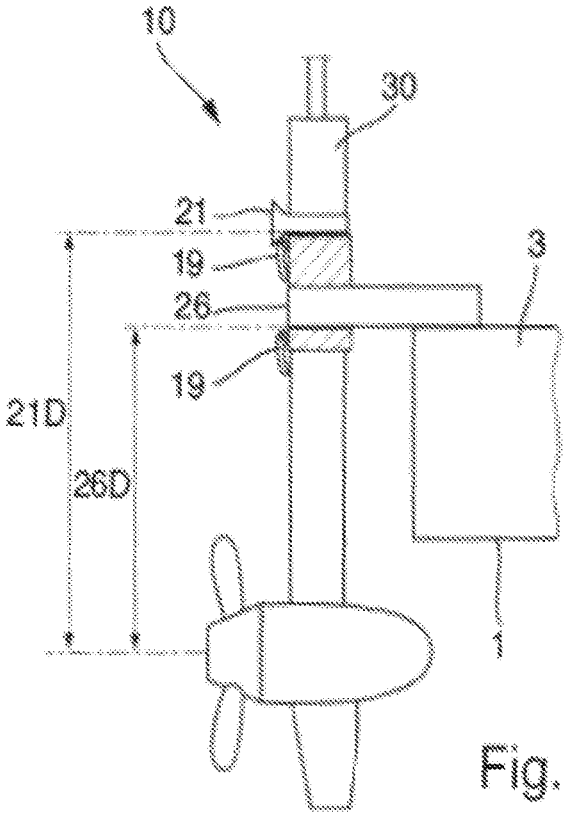

In FIGS. 4C-4D, the arresting element 19 and the further arresting element 19 (for example the arresting element that is arranged closer to the drive motor 12) are shown. The steering device 21 is arranged below the receiving device 26 in FIG. 4C and for example lies on the further arresting element 19. The receiving device 26 lies against the arresting element 19 and prevents the displacement of the shaft 16 along the longitudinal direction of the shaft 16 in the direction of the upper end of the shaft 16.

In some embodiments, the steering device 21 is clamped between the two arresting elements 19 (see FIGS. 1-3). Distances 21D and 26D are set in such a way that a change of distance 21D between the steering device and the drive motor 12 will enforce no change of distance 26D between the receiving device and the drive motor 12 or vice versa. The two distances can therefore be set independently from each other. FIG. 4D also shows a configuration with two arresting elements 19, wherein the steering device 21 is arranged above the receiving means. In some embodiments, the receiving device 26 is tensioned either between two arresting elements 19 or between an arresting element 19 and the steering device 21 to prevent a displacement of the motor. The connection device 30 can optionally be used for preventing a slipping out of the shaft in a gravitational direction (FIG. 4A and FIG. 4C).

As shown in FIGS. 1-4D, the connection device 30 is arranged at an upper end of the shaft 16 for fixing the shaft 16 against a displacement in the direction of the drive motor 12 along the longitudinal axis 17 of the shaft 16.

In some embodiments, the connection device 30 has a connection for connecting the drive motor 12 to a power source, in particular a battery. In addition to the function of supplying the drive motor 12 with power the connection device 30 can also have an arresting function, namely of blocking the shaft 16 against falling out in a gravitational direction and/or of blocking the steering device 21 in a longitudinal direction of the shaft 16 in the direction of the upper end of the shaft 16, as shown in FIG. 4B and FIG. 4D.

As shown in FIGS. 4A-4D, the drive arrangement 10 is designed for being fitted to a boat 1. The boat 1 has a fitting area on the top 3 of one boat end, where the drive arrangement 10 can be fitted to the boat 1.

In some embodiments, the boat 1, for example, has at least two steering elements (not shown), wherein one steering element each is fitted to a leg 34 of the steering device 21 (see FIG. 3) of the drive arrangement 10, so that the shaft 16 can be rotated around its longitudinal axis into a first or second direction through activating one of the two steering elements for steering the boat 1.

The arresting element is accordingly provided for setting a second desired distance 21D between the steering device 21 and the drive motor 12 along the longitudinal axis 17 of the shaft 16 in such a way that the steering elements and the steering device 21 are aligned with each other in a way that the steering elements extend substantially parallel to the top of the boat.

If the steering elements, for example, extend above the top 3 of the boat 1 then the steering device 21 is positioned above the receiving device 26, as shown in FIG. 4B and FIG. 4D, and is fixed to the shaft 16 by means of the arresting element 19. The opposite case is indicated as shown in FIG. 4A and FIG. 4C. The at least two steering elements here extend below or above the top along a longitudinal axis of the boat (not shown). Depending on whether the steering elements extend above or below the top of the boat, the position of the steering device can be adapted to the respective situation along the longitudinal axis of the shaft. Use of the arresting element therefore allows the steering device to be set to the different configurations of the steering elements in the boat.

As shown in FIG. 4C and FIG. 4D, the arresting element 19 is also provided for setting a first desired distance 26D between the receiving device 26 and the drive motor 12 in such a way that the drive motor 12 and the height of the stern are aligned with each other in such a way that the drive motor 12 is submersed in the water in a desired position. The height of the stern differs depending on the type of boat. The drive arrangement 12 can be adapted to the different stern heights by means of the arresting element 19. The drive arrangement can therefore be adapted to different boat types with different stern geometries of the boat.

Where applicable, all individual characteristics illustrated in the embodiment example can be combined with and/or exchanged for each other without departing from the scope of the disclosure.

All patents, patent applications, and published references cited herein are hereby incorporated by reference in their entirety. It will be appreciated that several of the above-disclosed and other features and functions, or alternatives thereof, may be desirably combined into many other different systems or application. Various alternatives, modifications, variations, or improvements therein may be subsequently made by those skilled in the art.

The invention claimed is:

1. A drive arrangement for propelling a boat, comprising:

a drive motor with a shaft;

a receiving device for receiving the shaft and attachable to a boat;

a steering device having a first leg and a second leg, the steering device being slidably disposed on the shaft to rotate the shaft around its longitudinal axis in a first direction or a second direction; and one or more steering elements, wherein the one or more steering elements are fitted to the first leg and the second leg of the steering device for pivoting the shaft around its longitudinal axis through activating one of the one or more steering elements for steering the boat.

2. The drive arrangement according to claim 1, wherein the first leg is connected to the second leg to define an opening for receiving the shaft therethrough for coupling the steering device to the shaft.

3. The drive arrangement according to claim 1, further comprising an arresting element defining a receptacle for receiving the shaft, the arresting element being displaceable relative to the receiving device along a longitudinal axis of the shaft received in the receptacle to determine a first desired distance along the shaft between the receiving device and the drive motor.

4. The drive arrangement according to claim 3, wherein the arresting element can be shifted into an opened position and into a closed position, wherein the arresting element can be displaced along the longitudinal axis of the shaft in the opened position and is fixed on the shaft in the closed position.

5. The drive arrangement according to claim 3, wherein the arresting element is designed as a clamp with a quick-release lever, wherein the arresting element can be shifted into a closed position through tensioning the quick-release lever and into an opened position through loosening the quick-release lever.

6. The drive arrangement according to claim 1, wherein the shaft is connected with the receiving device in such a way that the shaft can be rotated around a longitudinal axis of the shaft and the shaft can be displaced along the longitudinal axis of the shaft relative to the receiving device.

7. The drive arrangement according to claim 1, wherein the steering device is arranged either above or below the receiving device and is in contact with the receiving device.

8. The drive arrangement according to claim 3, further comprising a further arresting element that is arranged between the receiving device and the steering device, so that the receiving device and the steering device are at a distance from each other.

9. The drive arrangement according to claim 8, wherein the further arresting element is arranged in such a way in a closed position that either the steering device or the receiving device lies on the further arresting element for blocking the steering device or the receiving device against a displacement along the longitudinal axis of the shaft.

10. The drive arrangement according to claim 1, further comprising a connection device that is arranged at an upper end of the shaft for fixing a displacement of the shaft along the longitudinal axis of the shaft in a direction of the drive motor.

11. The drive arrangement according to claim 10, wherein the connection device has a connection for connecting the drive motor to a power source.

12. The drive arrangement according to claim 1, wherein the boat is a kayak.

13. A boat, comprising:

a drive arrangement comprising a drive motor with a shaft; a receiving device for receiving the shaft and attachable to a boat; a steering device having a first leg and a second leg, the steering device being slidably disposed on the shaft to rotate the shaft around its longitudinal axis in a first direction or a second direction for steering the boat; and one or more steering elements, wherein the one or more steering elements are fitted to the first leg and the second leg of the steering device for pivoting the shaft around its longitudinal axis through activating one of the one or more steering elements, for steering the boat.

14. The boat according to claim 13, wherein the first leg being connected to the second leg to define an opening for receiving the shaft therethrough for coupling the steering device to the shaft.

15. The boat according to claim 13, further comprising an arresting element defining a receptacle for receiving the shaft, the arresting element being displaceable relative to the receiving device along a longitudinal axis of the shaft received in the receptacle to determine a first desired distance along the shaft between the receiving device and the drive motor.

16. The drive arrangement according to claim 1, wherein the one or more steering elements comprise at least two steering elements, wherein the at least two steering elements are fitted to the first leg and the second leg of the steering device for pivoting the shaft around its longitudinal axis through activating one of the at least two steering elements for steering the boat.

17. The boat according to claim 13, wherein the one or more steering elements comprise at least two steering elements, wherein the at least two steering elements are fitted to the first leg and the second leg of the steering device for pivoting the shaft around its longitudinal axis through activating one of the at least two steering elements, for steering the boat.

* * * * *